United States Patent [19]

McClaskey

[11] 4,310,013

[45] Jan. 12, 1982

[54] SIPHON DEVICE

[76] Inventor: Billy M. McClaskey, 1089 Mildred St., La Verne, Calif. 91750

[21] Appl. No.: 133,630

[22] Filed: Mar. 24, 1980

[51] Int. Cl.[3] ..... F04F 10/00

[52] U.S. Cl. ..... 137/145; 137/212

[58] Field of Search ..... 137/145, 212

[56] References Cited

FOREIGN PATENT DOCUMENTS 2406 of 1873 United Kingdom ..... 137/145

*Primary Examiner*—Gerald A. Michalsky

*Attorney, Agent, or Firm*—Boniard I. Brown

[57] ABSTRACT

A device for siphoning various fluids including gasoline from a relatively closed container. The device includes a siphon tube about which is positioned an expandable bulb which is pressurized, usually with oral pressure, to expand and form a seal with the containers opening. A restricted outlet for such pressure is provided beneath the sealing surface of the bulb to allow this pressure to also pressurize the container into which the siphon is inserted, thereby forcing fluid up the siphon tube until siphon action starts. Thereafter, the pressure line provides a vent for the fluid container should the seal remain intact.

10 Claims, 3 Drawing Figures

SIPHON DEVICE

BACKGROUND OF THE INVENTION

A siphon is a very effective means for transferring fluid from one container to another. However, the reliable starting of the siphon action especially when the fluids to be transferred are hazardous has proved to be difficult. LOW in U.S. Pat. No. 310,863 discloses an effective device for siphoning from casks which includes a plug having a pressurizing tube and a siphoning tube passing therethrough. The Low device is only effective if the casks have uniformly sized, circular bung holes so that the frustroconical rubber plug can easily form a good seal therewith. In addition, Low provides means so that the pressurizing tube can be bent over to restrict the flow out of the siphon tube. STANSBURY discloses U.S. Pat. No. 314,487 an improvement over the Low device by providing a frustroconical plug with a sealed ring therearound to improve the sealing action, but at the same time restrict the use of his plug to openings of a specific size. At the same time, Stansbury provided a spring clip arrangement on the pressure tube to block it off when not manually biased to the open position during pressurizing of the liquid container. FLEINER, in U.S. Pat. No. 523,739 discloses a similar device which is meant to be placed in the receiver container. The second tube thereof which physically corresponds to the pressurizing tube of the aforementioned devices is used to produce a reduced pressure within the receiving container to start the siphon action. In LEE, U.S. Pat. No. 915,867, a prime retainer device is employed on the siphon tube which along with a pressurizing tube passes through a frustroconical stopper. As can be seen in the above discussed prior art, the stopper or plug is the weak link, it being required to fit snuggly through its own natural resilience to assure a seal with a container opening since the stopper must necessarily be self-supporting. The two requirements of self-supporting and providing a good seal with various size openings has made such devices suitable only when specifically applied to a narrow range of circular openings. Therefore, there has been a need for a siphon device which can be started easily in a relatively closed container which may have an opening over a wide range of sizes and other than a circular shape.

BRIEF DESCRIPTION OF THE PRESENT INVENTION

The present invention provides means for utilizing oral or other pressure for starting the siphoning action of various fluids including gasoline. The device includes a main siphon tube which passes through a resilient hollow bulb disposed about the siphon tube. A pressuring tube connects to the interior of the resilient bulb which in turn has a restricted outlet on the opposite side thereof from the pressurizing tube.

The bulb has an elastic sidewardly facing surface constructed from compliant material which is expanded when the interior thereof is pressurized by application of pressure through the pressurizing tube to form a seal with the container opening in which it is placed. A continuous flow of pressurized air must be provided through the pressurizing tube as it is allowed to leak out of the restricted outlet to in turn pressurize the fluid container at some lower level. This causes the fluid in the container to be forced up the siphon tube enabling a siphon action therethrough to start. Since pressure rather than suction is applied to the devices, there is no chance of ingestation or inhalation of fluid or vapors. This is extremely important when hazardous fluids are being transferred, such as gasoline. The present invention is relatively inexpensive to manufacture since no squeeze pump or one-way valve is required and provides a much more positive action than conventional devices which require mouth suction to produce a partial vacuum. After the siphon action has commenced, the pressurizing tube is removed from the mouth so that it can act like a vent for the tank should the seal of the bulb remain viable.

It therefore is an object of the present invention to provide an improved siphon device which can be operated by applied pressure without fear of introducing the fluid being siphoned into the mouth.

Another object is to provide a relatively economical siphon device which is easy to construct and use.

Another object is to provide a siphon device which can be used with fluid container openings of wide range and shape.

Another object is eliminate the need for a squeeze pump or a separate check valve as required in more conventional siphoning devices.

These and other objects and advantages of the present invention will become apparent to those skilled in the art after considering the following detailed specification together with the accompanying drawing wherein:

DETAILED DESCRIPTION OF THE SHOWN EMBODIMENTS

Figure 1:
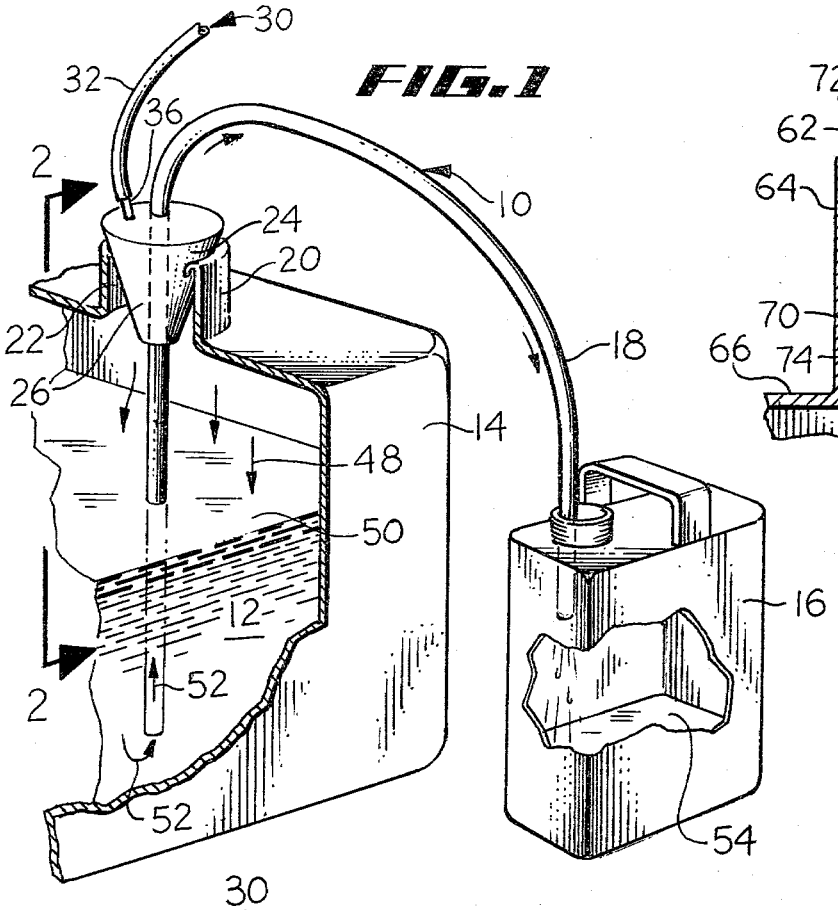
FIG. 1 is a partial cutaway perspective view of a preferred embodiment of the present invention in use siphoning fluid from one container to another.
Figure 2:
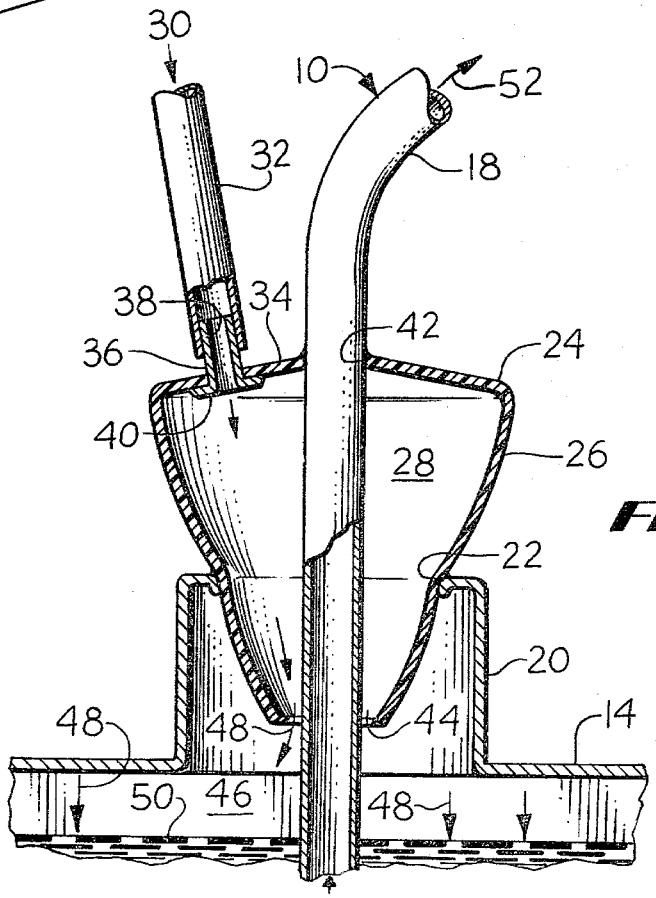
FIG. 2 is detailed, enlarged, cross-sectional view taken at lines 2—2 of FIG. 1.

Referring to the drawing more particularly by reference numbers, number 10 in FIG. 1 refers to a siphon device constructed according to the present invention. The device 10 is shown siphoning fluid 12 from a relatively closed container 14 to a smaller container 16, the fluid passing through a siphon tube 18 as shown. The siphon device 10 is installed in the neck 20 forming an opening 22 in the container 14. As shown in FIGS. 1 and 2, the device 10 includes a resilient flexible bulb 24 having a complient frustroconical outer surface 26. It is the surface 26 which is used to seal the bulb 24 in the opening 22 in the container 14. This seal is accomplished by pressing the bulb 24 within the opening 22 and then pressurizing the hollow interior 28 of the bulb 24 by pressure 30, typically oral, applied by means of a pressurizing tube 32 connected through the top portion 34 of the bulb 24. The pressurizing tube 32 may be formed integrally with the bulb 24 or a separate connector member 36 may be provided, the member 36 having a hollow nipple 38 over which the pressurizing tube 32 can be fitted and a flange 40 within the bulb for retention therein.

The siphon tube 18 extends centrally through the bulb 24, and is sealed thereto at an upper or top opening 42 while merely passing through a larger lower opening 44. The resilience of the bulb 24 may, in fact, contract the bulb portion about opening 44 about the siphon tube 18 to form a light seal therebetween to prevent pressure within the interior 46 of the container 14 from flowing back through the pressurizing tube 32 and into the mouth of the user. Even if this is the case, the resilience of the bulb 24 is such that pressure applied by means of the pressurizing tube 32 causes the bulb 24 to expand to allow the oral pressure 30, after being suitably diminished by the orificing action of the opening 44, to be exerted within the container 14 to pressurize the interior 46 thereof. This pressure 48 is applied to the surface 50 of the fluid 12 to force the fluid to flow, as indicated by the arrows 52, up and out of the tube 18 until the siphoning action shown in FIG. 1 can be commenced.

At that point, there is no longer need to apply oral pressure 30 to the pressurizing tube 32 as the fluid 12 will continue to flow into the container 16 until the fluid levels 50 and 54 in the two containers 14 and 16 equalize, assuming that the pressure 48 acting on the fluid surface 50 is the same as the pressure acting on the fluid surface 54 in the other container 16. This should be the case, as the siphon device 10 enables the interior 46 of the container 16 to receive atmospheric pressure through the pressurizing tube 30 and through the opening 44 or by breaking the seal formed by the surface 26.

Figure 3:
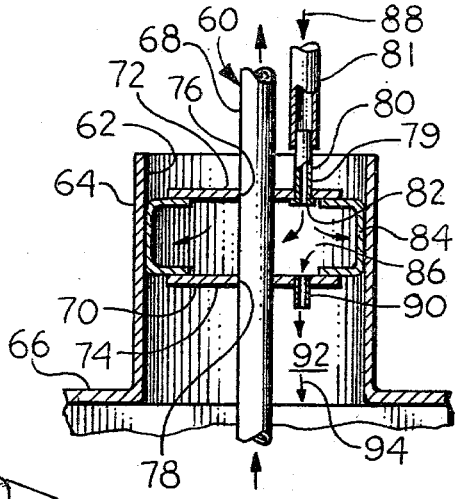
FIG. 3 is a cross-sectional view similar to FIG. 2 of a portion of a modified embodiment of the present invention.

A modified embodiment 60 is shown in FIG. 3. The device 60 is shown installed in the opening 62 of a neck 64 in a closed container 66. The device 60 has a siphon tube 68 located centrally through its plug 70 and is similar to device 10 except that the plug has relatively rigid top and bottom disc members 72 and 74 which are aligned radially to the siphon tube 68. The disc members 72 and 74 have openings 76 and 78 therethrough which are sealed to the siphon tube 68 which passes therethrough. A connector member 79 is provided through the upper member 72, it having a nipple 80 for connection to a pressurizing tube 81 and a retaining flange 82 for retention to the member 72. The two members 72 and 74 are connected together by a resilient ring 84 with which the members 72 and 74 form a chamber 86 similar to the interior 28 of the bulb 24. When the interior 86 is pressurized by oral pressure 88 applied by means of the pressurizing tube 81, the ring 84 expands outwardly to engage the neck 64 and form a seal therewith to close the opening 62.

The lower member 74 includes an orifice member 90 therethrough which can restrictively communicate the interior 86 of the plug 70 with the interior 92 of the container 66. This means the oral pressure 88 is diminished by the orifice 90 and then applied as pressure 94 within the container 66 to start the siphoning action as discussed in conjunction with FIGS. 1 and 2.

Thus there has been shown and described novel siphoning devices which fulfill all the objects and advantages sought therefore. Many changes, modifications, variations, and other uses and applications of the subject siphoning devices will become apparent to those skilled in the art after considering this specification and the accompanying drawing. All such changes, modifications, alterations and other uses and applications which do not depart from the spirit and scope of the invention are deemed to be covered by the invention which is limited only by the claims which follow.

The inventor claims:

1. A device for siphoning fluids such as gasoline outwardly via the neck of a fluid container, said device including:

a first tube for flow of the fluid out of the container, said first tube having an outlet end and having an inlet end for immersion in the fluid;

a second tube having an outlet end and having an inlet end for the application of pressure thereto; and a hollow plug through which said first tube extends, said plug having a hollow interior, an expandable side wall positioned for sealing engagement with the neck of the container, means for connecting said second tube outlet end so that pressure in said second tube is applied within said hollow interior of said plug to expand said side wall into sealing engagement with the neck of the container, and a restrictive outlet positioned between said first tube inlet and the sealing engagement of said side wall and container neck to apply reduced pressure within the container and thereby to force the fluid from the inlet end to the outlet end of the first tube.

2. A siphoning device according to claim 1, wherein:

said plug includes an upper portion through which said first tube extends in sealed relation with said side wall extending from said upper portion and being frustro-conical in shape with a larger diameter end connecting to said top of said plug.

3. A device according to claim 2, wherein:

said side wall extends toward said inlet end of said first tube until said side wall is closely adjacent said first tube to form said restrictive outlet thereabout.

4. A device as defined in claim 3, wherein:

said means for connecting said second tube outlet end so that pressure in said second tube is applied within said hollow interior thereof to expand said side wall into sealing engagement with the neck of the container include a connector member which extends through said top and has a nipple for sealing connection to said second tube and a flange for sealing connection to said top.

5. A device as defined in claim 3, wherein:

said plug restrictive outlet forms sealing contact with said first tube when ambient pressure is present within said hollow interior of said plug.

6. A device as defined in claim 1, wherein:

said plug has first and second end portions through which said first tube passes positioned with at least a portion of said side wall therebetween, said means for connecting said second tube outlet end so that pressure in said second tube is applied within said hollow interior of said plug to expand said side wall into sealing engagement with the neck of the container being connected to said first end of said plug, and said restrictive outlet being positioned through said second end of said plug.

7. A device as defined in claim 6, wherein:

said plug first and second ends are relatively stiff in comparison to said side wall and are discs radially oriented with respect to said first tube.

8. A device as defined in claim 7, wherein:

said means for connecting said second tube outlet end so that oral pressure in said second tube is applied within said hollow interior of said plug to expand said side wall into sealing engagement with the neck of the container include a connector member which passes through said first end of said plug and has a nipple for sealing connection to said second tube and a flange for sealing connection to said first end of said plug.

9. A device according to claim 8, wherein:

said restrictive outlet is an orifice through said second end of said plug.

10. A device according to claim 9, wherein:

said side wall of said plug is ring-shaped having a cylindrical portion.

* * * * *